US005722486A

United States Patent [19]

Blomgren et al.

[11] Patent Number: 5,722,486

[45] Date of Patent: Mar. 3, 1998

[54] PLATE HEAT EXCHANGER

[75] Inventors: Ralf Blomgren, Skanör; Bo Nilsson, Kävlinge; Mats Nilsson, Lund, all of Sweden

[73] Assignee: Alfa Laval AB, Lund, Sweden

[21] Appl. No.: 737,618

[22] PCT Filed: May 17, 1995

[86] PCT No.: PCT/SE95/00552

§ 371 Date: Nov. 7, 1996

§ 102(e) Date: Nov. 7, 1996

[87] PCT Pub. No.: WO95/31681

PCT Pub. Date: Nov. 23, 1995

[30] Foreign Application Priority Data

May 18, 1994 [SE] Sweden ..... 9401756

[51] Int. Cl.[6] ..... F28D 9/00; F28F 3/10

[52] U.S. Cl. ..... 165/167; 165/DIG. 371

[58] Field of Search ..... 165/166, 167, 165/DIG. 371

[56] References Cited

U.S. PATENT DOCUMENTS

| | | | |
|---|---|---|---|
| 5,327,958 | 7/1994 | Machata et al. | 165/167 |
| 5,462,113 | 10/1995 | Wand | 165/167 |

FOREIGN PATENT DOCUMENTS

| | | |
|---|---|---|
| 63-135786 | 6/1988 | Japan . |
| 304 293 | 9/1968 | Sweden . |
| 580 368 | 9/1946 | United Kingdom . |
| 2 126 703 | 3/1984 | United Kingdom . |
| 92/11501 | 7/1992 | WIPO . |

*Primary Examiner*—Allen J. Flanigan
*Attorney, Agent, or Firm*—Fish & Richardson P.C.

[57] ABSTRACT

The present invention refers to a plate heat exchanger (1) for heat transfer between two fluids, comprising several permanently joined modules (2), each consisting of two outer heat transfer plates (3) and between these several principally rectangular inner heat transfer plates (4), which have inlet and outlet openings (12) for respective fluids. The outer heat transfer plates (3) show smaller inlet and outlet openings (12) than the inner heat transfer plates (4), so that the modules (2) can be welded with each other around the inlet and outlet openings (12) of the outer heat transfer plates (3).

7 Claims, 1 Drawing Sheet

PLATE HEAT EXCHANGER

Figure 1:
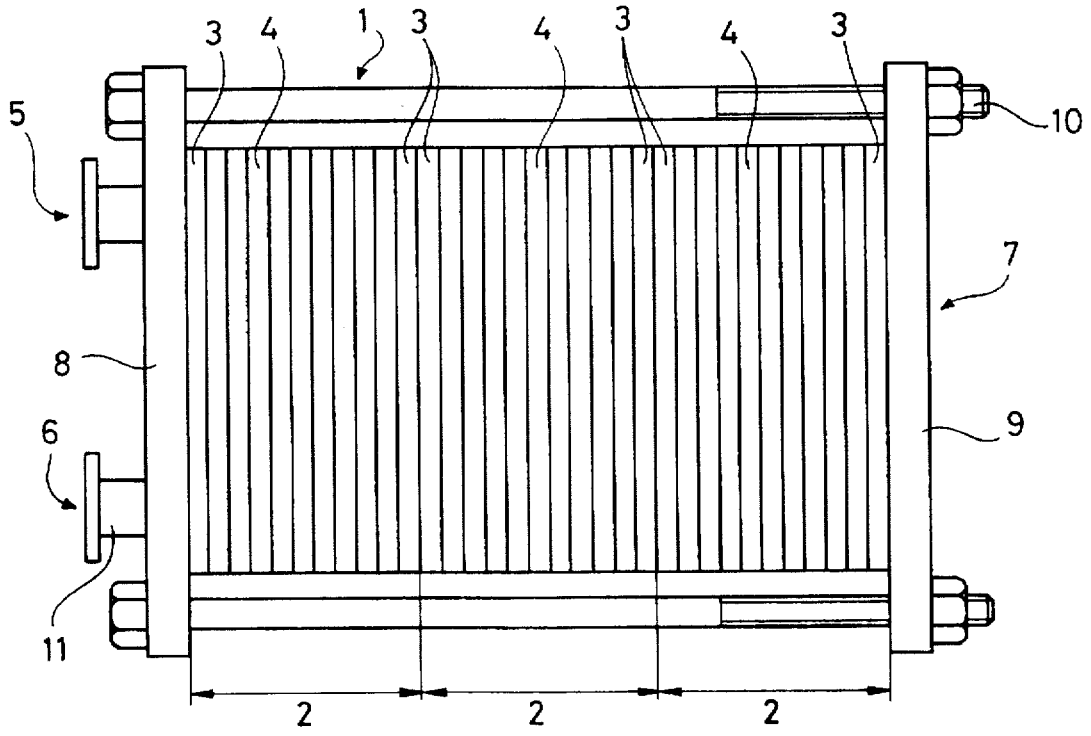

The present invention refers to a plate heat exchanger for heat transfer between two fluids, comprising several permanently joined modules, each consisting of two outer heat transfer plates and between these several principally rectangular inner heat transfer plates, which have inlet and outlet openings for respective fluids in their corner portions.

Permanently joined plate heat exchangers are known for instance by GB 0580368 and GB 2126703. These may be produced in shape of all-welded plate heat exchangers in such a way that the heat transfer plates first are welded together in pairs along an inner line and then two such pairs of plates are welded together along an outer line. An all-welded plate heat exchanger may also be produced in such a way that several heat transfer plates are welded together simultaneously. However, the size of the plate heat exchanger becomes limited to the number of heat transfer plates, which presently may be welded simultaneously.

Previously known all-welded plate heat exchangers cannot be taken apart if a leakage arises, instead the whole of the plate heat exchanger must be discarded in case of a possible defect.

As an alternative to an all-welded plate heat exchanger, modules composed of 10–20 heat transfer plates, may be welded together. After testing the modules, they are assembled to a complete plate heat exchanger by means of intermediate gaskets, which admit that the modules may be dismantled from each other and replaced with new in case of a possible defect. Such plate heat exchangers are previously known through SE 304 293 and WO 92/11501. The disadvantage with these is that the intermediate gaskets limit the applicability of the plate heat exchangers.

The objects with the present invention are to avoid the disadvantages and limitation existing in plate heat exchangers of the above mention kind and to make a safe joining of modules possible, simultaneously as the modules may be taken apart from each other and replaced with new in case of a possible leakage or another defect.

These objects are attained with the present invention, which principally is characterized in that said outer heat transfer plates have smaller inlet and outlet openings for at least one fluid relative said inner heat transfer plates and that said modules are joined to each other round said inlet and outlet openings of respective outer heat transfer plates.

During joining of the modules, by means of welding, a welding set must be introduced in the inlet and outlet openings of one of the modules, so that the welding tip reaches the joint between the modules. By the present invention it has been easy to locate and reach the edges to be welded.

The present invention also refers to a plate heat exchanger for heat transfer between two fluids, comprising several permanently joined modules, each consisting of two outer heat transfer plates and between these, several principally rectangular inner heat transfer plates, which have inlet and outlet openings for respective fluids in their corner portions and a heat transfer portion located between respective inlet and outlet openings, characterized in that said outer heat transfer plates of two adjacent modules abut against each other in at least a continuous area round the inlet and outlet openings, respectively, at least for one fluid, and are joined to each other by means of a radial edge-weld, extending round the edge of said inlet and outlet openings of the outer heat transfer plates.

Figure 2:
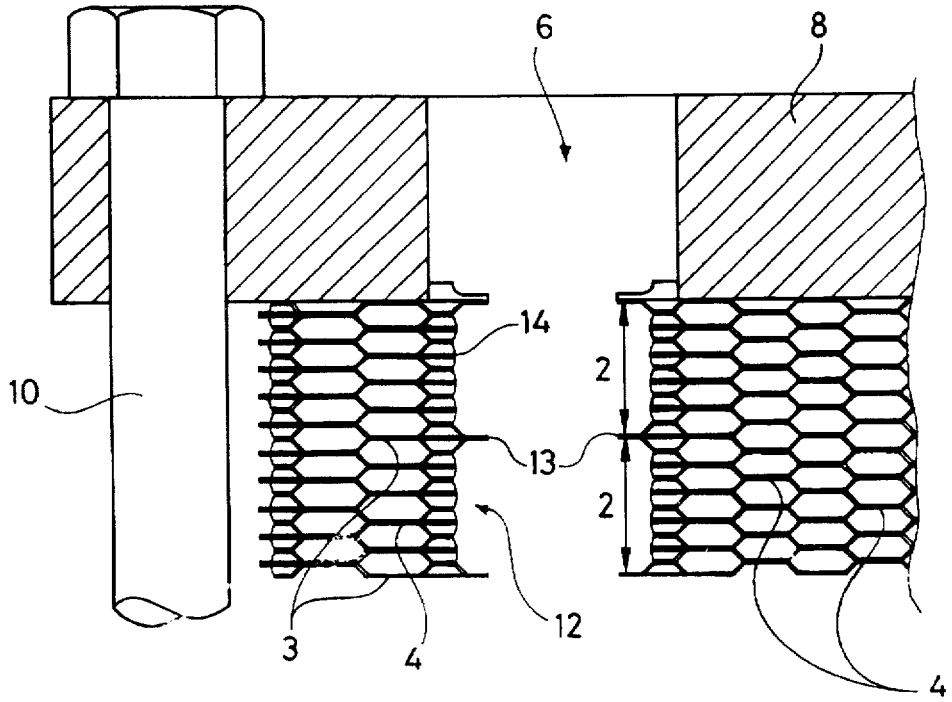

The invention will be described closer in the following, with reference to the accompanying drawing, on which:

FIG. 1 shows a schematic side-view of a plate heat exchanger according to the invention, and FIG. 2 shows a cross-section through a part of a passage of the plate heat exchanger according to FIG. 1.

In FIG. 1 a plate heat exchanger 1 for heat transfer between two fluids is shown, comprising several permanently joined modules 2, each consisting of two outer heat transfer plates 3 and between these, several principally rectangular inner heat transfer plates 4. Through the plate heat exchanger 1 there are passages 5 and 6 for respective fluids. The modules 2 are located in a frame 7, of a conventional kind, comprising at least a front end plate 8 and a rear end plate 9 and several tightening bolts 10. The front end plate 8 has connections 11, communicating with the passages 5 and 6 for a first fluid and with the passages (not shown) for a second fluid.

The heat transfer plates 3, 4 are, by pressing, provided with a pattern, in shape of ridges and grooves, which ridges of alternating first and second heat transfer plates 3, 4 abut against each other. The heat transfer plates 3, 4 are elded to each other or somehow permanently joined with each other, for instance by gluing, soldering or combinations of such. The heat transfer plates delimit in every other plate interspace a flow space for the first fluid and in the remaining plate interspaces flow spaces for the other fluid.

In FIG. 2 a schematical cross-section through a part of the front endplate 8 (without said connections) and through two adjacent modules 2 is shown. The outer and inner heat transfer plates 3 and 4 are elongated and mainly rectangular, although other shapes are also possible, such as rounded, and being produced of thin metal plate, which by pressing are provided with a conventional corrugation pattern.

The outer and inner heat transfer plates 3 and 4 have inlet and outlet openings 12 located in the corner portions of the heat transfer plates. Generally, the inlet and outlet openings 12 are circular, but other shapes are also possible, such as triangular or rectangular, and the shape of the openings does not limit the invention.

The inlet and outlet openings 12 for the first fluid are located at one long side of the heat transfer plates and the inlet and outlet openings for the other fluid are located at the other long side of the heat transfer plates, in case of a so called parallel flow. I.e. when the main flow directions for the fluids, flowing on each sides of the heat transfer plates, intend to be parallel. Naturally, the heat transfer plates may also be adapted to diagonal flow if desired.

The outer heat transfer plates 3 preferably have smaller inlet and outlet openings 12 than the inner heat transfer plates 4. By this, the edge 13 of the inlet and outlet openings of the outer heat transfer plates 3 extends longer into the passages 5 and 6, than the edge 14 of the inner heat transfer plates 4.

Owing to that the edge 13 of the outer heat transfer plates 3 of the modules 2 extends some millimeters outside the edge 14 of the remaining heat transfer plates 4, it becomes more simple to bring a welding set in correct position in the passage, both regarding to an axial and radial position of welding the modules together. The welding can be done as radial edge-weld or axial lap-weld.

With radial edge-weld it is meant a weld done towards the edge of two against each other abutting heat transfer plates. I.e. a welding set is moved from the center of the passage radially outwards in the plane of the plate towards the edges of the openings, which subsequently are butt-welded or fuse-welded together.

With axial lap-weld it is meant a weld done perpendicular towards two heat transfer plates abutting each other. I.e.

a welding set is moved axially in the passage perpendicular towards one of the heat transfer plates. The weld is then done as a seam-weld, a short way in on the heat transfer plate and on distance from the edge of the opening.

Naturally, the openings of two outer heat transfer plates abutting against each other could be of different size, and consequently the weld could also be formed as a fillet-weld.

Preferably, the outer heat transfer plates 3 are designed in such a way, that the whole weld can be located in an area of the outer heat transfer plates 3, extending within the edge 14 of the inner heat transfer plates 4. I.e. the outer heat transfer plates 3 of two adjacent modules 2, abutting against each other in at least a continuous area round the inlet and outlet openings 12, which radially are defined by the edge 13 of the inlet and the outlet openings of the outer heat transfer plates 3 and the edge 14 of the inlet and outlet openings 12 of the inner heat transfer plates 4. It will then become possible, in a simple manner, to locate the different modules 2 of a completed plate heat exchanger 1.

By a possible defect of any of the modules 2, the weld of a radial edge-weld may be around away, and the plate material round the weld of an axial lap-weld may be cut away, and then the faulty module can be removed. Any material of the plates from the faulty module, which remains on an adjacent module, may then be milled or ground away, and a new module 2 can be welded to replace the faulty module.

With the exception of those portions round the inlet and outlet openings 12, the outer heat transfer plates 3 have been shown identical to the inner heat transfer plates 4, and both sides of the same are intended to be in contact with the heat transfer fluids. Naturally, it may also be possible to specially design the outer heat transfer plates, to be in contact only with one of the fluids. I.e. the fluid should not flow in the space between the modules 2.

It should also be possible to introduce separate spacing means, in shape of rings or plane plates of thicker material, between the modules as desired. For instance when the edge portions of the outer heat transfer plates of any reason do not abut against each other. Such spacing means are located between the outer heat transfer plates of two adjacent modules and are permanently joined with the outer heat transfer plates.

We claim:

1. Plate heat exchanger (1) for heat transfer between two fluids, comprising:

a) a frame including two spaced frame plates (8,9), b) a plurality of plate modules (2), each comprising two principally rectangular outer heat transfer plates (3) and between these a stack of principally rectangular inner heat transfer plates (4), wherein said outer heat transfer plates (3) have smaller inlet and outlet openings (12) for at least one fluid than do said inner heat transfer plates (4); and c) tightening bolts (10) adapted to clamp said plate modules (2) between said frame plates (8,9), said inner and outer heat transfer plates being substantially thinner than said frame plates, and having inlet and outlet openings (12) for respective fluids in their corner portions and being welded together, wherein said modules (2) are welded to each other around said smaller inlet and outlet openings (12) of their respective outer heat transfer plates (3) facing each other.

2. Plate heat exchanger according to claim 1, wherein the outer heat transfer plates (3) of two adjacent modules (2) abut against each other in at least a continuous area around the inlet and outlet openings (12), radially defined by the edge (13) of the inlet and outlet openings (12) of the outer heat transfer plates (3) and the edge (14) of the inlet and outlet openings (12) of the inner heat transfer plates (4).

3. Plate heat exchanger according to claim 2, wherein the outer heat transfer plates (3) of two adjacent modules (2) are welded to each other in said area.

4. Plate heat exchanger according to claim 3, wherein the weld is designed as an axial lap-weld.

5. Plate heat exchanger according to claim 1 wherein said modules (2) are welded to each other around said smaller inlet and outlet openings (12) of said respective outer heat transfer plates (3) by means of radial edge-welds.

6. Plate heat exchanger according to claim 3 wherein said two adjacent modules (2) are welded to each other in said area by means of an axial lap-weld.

7. Plate heat exchanger according to claim 2 wherein said modules (2) are welded to each other around said smaller inlet and outlet openings (12) of said respective outer heat transfer plates (3) by means of radial edge-welds.

* * * * *

UNITED STATES PATENT AND TRADEMARK OFFICE

CERTIFICATE OF CORRECTION

PATENT NO. : 5,722,486

DATED : March 3, 1998

INVENTOR(S) : Ralf Blomgren, et al

It is certified that error appears in the above-identified patent and that said Letters Patent is hereby corrected as shown below:

Col. 3, line 22, change "around" to --ground--.

Signed and Sealed this

Seventeenth Day of November, 1998

Bruce Lehman

*Attest:*

BRUCE LEHMAN

*Attesting Officer*

*Commissioner of Patents and Trademarks*